United States Patent [19]

Neal

[11] 4,011,821

[45] Mar. 15, 1977

[54] TABLE

[75] Inventor: Jerry L. Neal, Columbus, Ind.

[73] Assignee: Cosco, Inc., Columbus, Ind.

[22] Filed: Oct. 29, 1975

[21] Appl. No.: 626,990

[52] U.S. Cl. ..... 108/156; 248/188

[51] Int. Cl.[2] ..... A47B 3/06

[58] Field of Search ..... 108/34, 38, 156, 115; 248/68, 74 A, 188.8, 188; 403/365, 361

[56] References Cited

UNITED STATES PATENTS

| | | | |
|---|---|---|---|
| 1,747,691 | 2/1930 | Bellows | 108/156 X |
| 1,762,776 | 6/1930 | Gardner | 108/156 |
| 2,529,219 | 11/1950 | Kost | 403/361 |
| 2,673,772 | 3/1954 | Beasley | 108/156 |
| 2,885,460 | 5/1959 | Borresen | 248/74 A |
| 2,948,937 | 8/1960 | Rapata | 248/68 R |
| 3,098,275 | 7/1963 | Schweitzer | 403/365 |
| 3,247,811 | 4/1966 | Bauder | 108/115 |
| 3,338,600 | 8/1967 | Wahl | 403/361 X |
| 3,674,229 | 7/1972 | Keeler | 248/188 |
| 3,730,109 | 5/1973 | Kreizel | 108/156 |
| 3,865,050 | 2/1975 | Cecchetti | 248/188.8 |
| 3,883,104 | 5/1975 | Delafield | 108/156 X |

*Primary Examiner*—James T. McCall
*Attorney, Agent, or Firm*—Jenkins, Hanley & Coffey

[57] ABSTRACT

A table having a plurality of legs receivable in sockets on the underside of a table top to place said table in an upright condition. The legs are removable from the sockets and storable within clips on the underside of the top to place the table in a knocked-down condition.

10 Claims, 5 Drawing Figures

TABLE

SUMMARY OF THE INVENTION

In accordance with the invention, a table is provided comprising a table top unit and a plurality of tubular legs. The top unit has a plurality of sockets mounted on the underside thereof, and each socket comprises a metal sleeve having an elastomeric bushing received therein. Each socket is sized and shaped for snug reception of one of the tubular legs whereby the top is supportable above the floor by said legs.

The top unit also has a plurality of spring clips mounted on the underside thereof. These clips are sized and shaped to releasably retain the tubular legs in a plane adjacent to and parallel with the plane of the top unit. Thus, the table is placed in a knocked-down condition by removing said legs from their respective sockets and retaining them closely adjacent the top unit within said clips.

BRIEF DESCRIPTION OF THE DRAWINGS

The accompanying drawings illustrate the invention. In such drawings.

DETAILED DESCRIPTION OF THE PREFERRED EMBODIMENT

Figure 1:
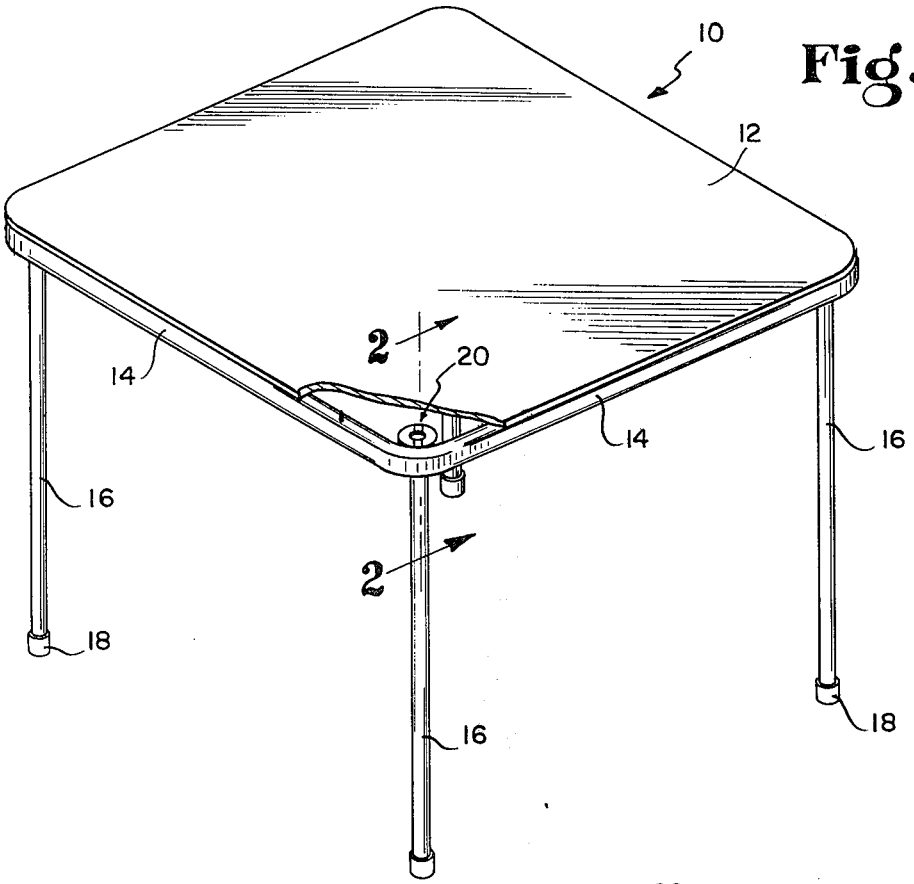
FIG. 1 is a perspective view of a table of this invention, with portions thereof broken away.

The table 10 of this invention is shown generally in FIG. 1, and comprises a table top unit having a rectangular planar top 12 connected to a peripherally depending frame 14. In the upright condition shown, the top 12 and frame 14 are supported above the floor by a plurality of tubular legs 16. Conveniently, if desired, said legs 16 are provided at their lower ends with rubber caps 18 or the like to prevent marring of the floor.

Figure 2:
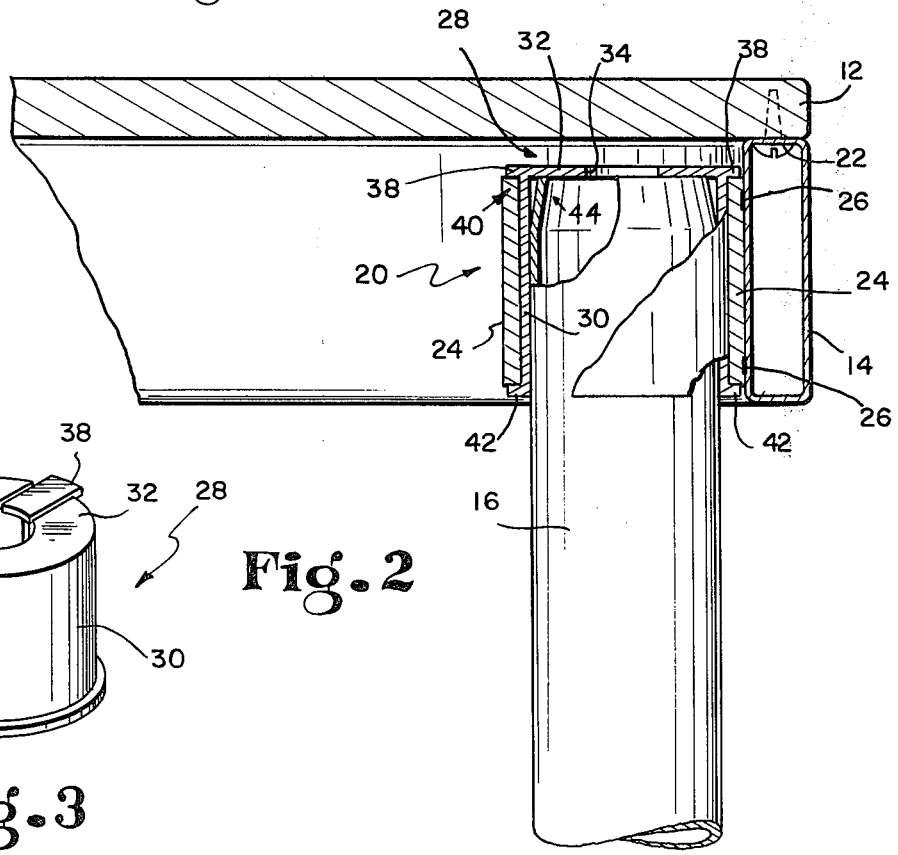
FIG. 2 is an enlarged vertical section taken on the line 2—2 of FIG. 1, with portions thereof broken away.

A socket 20 is provided inside each corner of the peripheral frame 14 for removably receiving and supporting the tubular legs 16, with one of said sockets and its connection to the frame 14 being shown by way of example in FIG. 2. As shown, the frame 14 is suitably connected as by screws 22 to the overlying table top 12. Inside each corner of the frame, the socket comprising a metal sleeve 24 is fixed as by welds 26 to the frame. The sleeve 24 is oriented vertically with its central axis normal to the plane of the table top, and has a length approximately equal to the height of the table frame 14.

Figure 3:
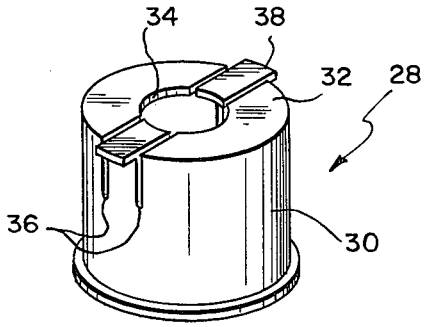
FIG. 3 is a perspective view of a preferred socket bushing for the table.

A bushing 28 formed from an elastomeric material is press-fit within the sleeve 24. The bushing is shown in greater detail in FIG. 3, and comprises a unitary body having a cylindrical wall 30 sized and shaped to tightly fit within the sleeve. The bushing has an upper face 32 extending radially inwardly at least a short distance from the cylindrical wall 30 and terminating in a central opening 34. The upper face 32 also has a pair of opposed, outwardly extending tabs 38 which are yieldable inwardly a short distance by virtue of slots 36 formed in said upper face and in the cylindrical wall 30. The bushing 28 is thus press-fit upwardly into the sleeve 24 until the tabs 38 snap over the upper extent of the sleeve, as at 40. A flange 42 encircles the lower extent of the bushing to engage the bottom of the sleeve and thereby limit upward bushing movement.

A leg 16 is receivable upwardly into each of the sockets 20. The legs are formed from metal tubing or the like, and have a diameter approximately equal to or slightly greater than the inside diameter of the socket bushings 28. Thus, the upper ends of the legs scrub tightly against the inside of the bushing walls 30 for substantially the entire length of said bushings to form a solid and relatively wobble-free interconnection between the top unit and the legs, with said upper bushing faces 32 serving to limit upward leg movement. Conveniently, as shown in FIG. 2, the extreme upper end of each leg 16 is necked inwardly to a reduced cross-sectional diameter, as at 44, to allow easy starting of the legs into the sockets.

Figure 4:
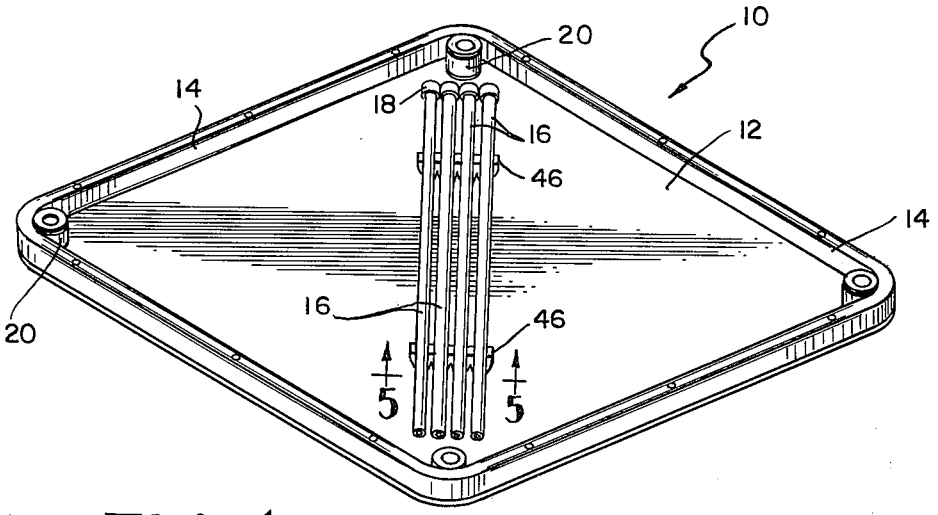
FIG. 4 is a perspective view of the table of FIG. 1 in a knocked-down condition and showing the underside thereof.
Figure 5:
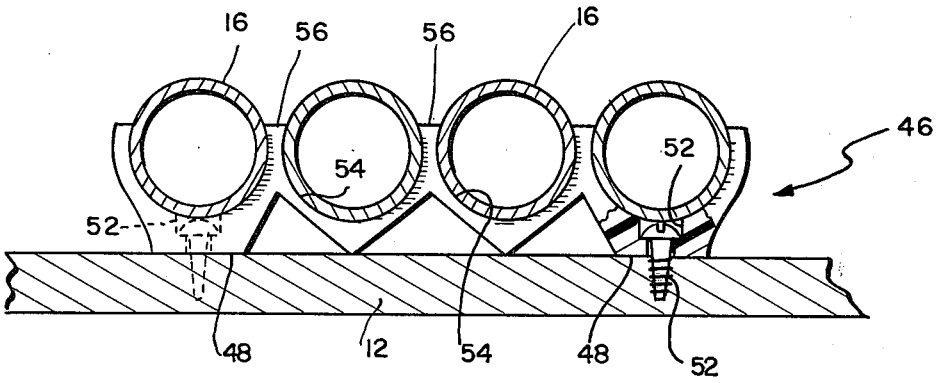
FIG. 5 is an enlarged vertical section taken on the line 5—5 of FIG. 4, with portions thereof broken away.

As shown in FIGS. 4 and 5, a pair of spring clips 46 are mounted on the underside of the table top 12 for storing the legs 16 upon removal thereof from the sockets 20 to place the table in a knocked-down condition. Each clip 46 is formed from a relatively resilient material such as plastic and has flat base surfaces 48 for engaging the underside of the top 12. Screws 50 are received through countersunk openings 52 in each clip to fasten the same to the top. The clips each comprise a series of arcuate recesses 54 separated by upstanding fingers 56, with each recess being sized for reception of one of the legs 16. The legs 16 are receivable side-by-side within the clips by pressing them into the recesses 54. Adjacent ones of the fingers 56 momentarily spring apart to allow passage of a leg into a recess, and then spring back to removably retain the leg in a plane parallel with and closely adjacent to the plane of the table top 12. Importantly, as shown in FIG. 4, the two clips are positioned on the underside of the top with their respective recesses aligned so that each of the legs is receivable near the opposed ends thereof in the clips.

While the table of this invention has been shown and described as having a rectangular top and four removable legs, it should be understood that the scope of this invention is not so limited. The table can comprise a top of any desired shape, with the number and position of legs and associated sockets being dependent upon the shape of the top as well as visual design considerations.

I claim:

1. In combination, a table comprising a generally planar top unit, a plurality of legs, a plurality of sockets each having a sleeve connected to said top unit with its central axis generally normal to the plane of said top unit and an elastomeric bushing received within said sleeve and shaped for snug reception of one end of one of said legs, said bushings each having a radially inwardly extending upper face at the upper end thereof to limit upward leg movement therein, each of said bushings also having tabs extending radially outwardly from said upper face and radially outwardly extending flange means at the lower end thereof for respective reception over and engagement with the upper and lower extents of the associated sleeve to limit bushing movement within said sleeve, and a clip mounted on the underside of said top unit and having a plurality of recesses formed therein for receiving said plurality of legs, said plurality of legs being selectively and alternately receivable in said sockets for placing the table in an upright condition and in said clip for placing the table in a knocked-down condition.

2. The combination as set forth in claim 1 wherein said top unit comprises a generally planar top with a frame connected thereto and depending from the periphery thereof, said plurality of sockets being mounted on said frame.

3. The combination as set forth in claim 1 wherein one end of each of said legs is necked inwardly to a reduced cross section for easy starting into one of said sockets.

4. The combination as set forth in claim 1 wherein a pair of said clips are mounted on said top unit with their respective recesses aligned so that each of said legs is removably receivable near each end thereof in said clips.

5. In combination, a table comprising a generally planar top unit, a plurality of legs, a plurality of downwardly open rigid sleeves mounted on the underside of said top unit with their central axes generally normal to the plane of said top unit, a plurality of elastomeric bushings each carried in one of said sleeves and shaped for snug reception of one end of one of said legs, said bushings each having a radially inwardly extending upper face at the upper end thereof to limit upward leg movement therein, each of said bushings also having tabs extending radially outwardly from said upper face and radially outwardly extending flange means at the lower end thereof for respective reception over and engagement with the upper and lower extents of the associated sleeve to limit bushing movement within said sleeve, and a plurality of clips mounted on the underside of said top unit and each having a plurality of recesses formed therein for receiving said plurality of legs, said plurality of legs being selectively and alternately receivable in said sockets for placing the table in an upright condition and in said clips for placing the table in a knocked-down condition.

6. In combination, a table comprising a generally planar top unit, a plurality of legs, a plurality of sleeves mounted on said top unit with their axes generally normal to the plane of said top unit, a plurality of elastomeric bushings each received within one of said sleeves and shaped for snug reception of one end of one of said legs, and bushings each having a radially inwardly extending upper face at the upper end thereof to limit upward leg movement therein, each of said bushings also having tabs extending radially outwardly from said upper face and radially outwardly extending flange means at the lower end thereof for respective reception over and engagement with the upper and lower extents of the associated sleeve to limit bushing movement within said sleeve, said plurality of legs each having one end receivable in one of said sleeves for placing the table in an upright condition.

7. The combination as set forth in claim 6 with the addition of a clip mounted on the underside of said top unit and having a plurality of recesses formed therein for receiving said plurality of legs, said plurality of legs being alternately receivable in said clip for placing the table in a knocked-down condition.

8. The combination as set forth in claim 1 wherein said elastomeric bushings each comprise a cylinder having said upper face extending radially inwardly from one end thereof and said flange means extending radially outwardly from the other end thereof, said tabs each having a first portion extending axially along said cylinder and forming a part thereof and a second radially outwardly extending portion generally coplanar with said upper face, said first portions of said tabs being laterally spaced from the remainder of said cylinder by axially extending slots whereby said second portions of said tabs are springably yieldable in a radially inward direction.

9. The combination as set forth in claim 5 wherein said elastomeric bushings each comprise a cylinder having said upper face extending radially inwardly from one end thereof and said flange means extending radially outwardly from the other end thereof, said tabs each having a first portion extending axially along said cylinder and forming a part thereof and a second radially outwardly extending portion generally coplanar with said upper face, said first portions of said tabs being laterally spaced from the remainder of said cylinder by axially extending slots whereby said second portions of said tabs are springably yieldable in a radially inward direction.

10. The combination as set forth in claim 6 wherein said elastomeric bushings each comprise a cylinder having said upper face extending radially inwardly from one end thereof and said flange means extending radially outwardly from the other end thereof, said tabs each having a first portion extending axially along said cylinder and forming a part thereof and a second radially outwardly extending portion generally coplanar with said upper face, said first portions of said tabs being laterally spaced from the remainder of said cylinder by axially extending slots whereby said second portions of said tabs are springably yieldable in a radially inward direction.

* * * * *

UNITED STATES PATENT OFFICE

CERTIFICATE OF CORRECTION

Patent No. 4,011,821 Dated March 15, 1977

Inventor(s) Jerry L. Neal

It is certified that error appears in the above-identified patent and that said Letters Patent are hereby corrected as shown below:

Column 3, line 46, change "and" to --said--.

Signed and Sealed this

Thirty-first Day of May 1977

[SEAL]

*Attest:*

RUTH C. MASON
*Attesting Officer*

C. MARSHALL DANN
*Commissioner of Patents and Trademarks*